US006071057A

United States Patent [19]

Duron et al.

[11] Patent Number: 6,071,057

[45] Date of Patent: Jun. 6, 2000

[54] CONTAINER BODY FOR RECYCLABLE REFUSE COLLECTION VEHICLE

[76] Inventors: Philippe Duron, 25 rue Merlin, Hull, Quebec, Canada, J9A 2R5; Alain Duron, 53 rue Duhamel, Hull, Quebec, Canada, J9A 1R1

[21] Appl. No.: 09/071,349

[22] Filed: May 1, 1998

[30] Foreign Application Priority Data

May 2, 1997 [CA] Canada ..... 2204318
Jul. 22, 1997 [CA] Canada ..... 2211288

[51] Int. Cl.[7] ..... B65F 3/20

[52] U.S. Cl. ..... 414/406; 414/512; 414/517; 414/525.6

[58] Field of Search ..... 414/406, 407, 414/409, 487, 492, 497, 511, 512, 517, 521, 525.2, 525.6, 679

[56] References Cited

U.S. PATENT DOCUMENTS

| | | | |
|---|---|---|---|
| 2,996,203 | 8/1961 | Rosaia | 414/679 |
| 3,643,824 | 2/1972 | Partridge | 414/492 |
| 3,750,813 | 8/1973 | Fishburne | 414/525.6 X |
| 4,057,154 | 11/1977 | Neufeldt | 414/525.2 |
| 4,310,279 | 1/1982 | Johnston | 414/406 X |
| 5,035,564 | 7/1991 | Matsumoto | 414/487 X |
| 5,203,669 | 4/1993 | Klossek et al. | 414/525.2 |
| 5,344,273 | 9/1994 | Radlein | 414/406 X |
| 5,813,818 | 9/1998 | McNeilus et al. | 414/407 |

FOREIGN PATENT DOCUMENTS

| | | | |
|---|---|---|---|
| 295574 | 12/1988 | European Pat. Off. | 414/406 |
| 365514 | 4/1990 | European Pat. Off. | 414/521 |
| 2642738 | 8/1990 | France | 414/409 |
| 91/00231 | 1/1991 | WIPO | 414/517 |

*Primary Examiner*—James W. Keenan
*Attorney, Agent, or Firm*—Robert G. Hendry

[57] ABSTRACT

A refuse collection container for mounting on a vehicle. The container is particularly suitable for separating and compacting recyclable materials due to the provision of a longitudinally extending diagonal partition. The container has a pair of refuse receiving buckets adapted to be raised into alignment with apertures in the front wall of the container. Recyclable materials, sorted by type in the buckets, are then moved into the container by a compactor blade in each bucket. Discharge of the materials is facilitated by providing for swinging movement of the partition prior to the vehicle being in the dumping position.

7 Claims, 10 Drawing Sheets

CONTAINER BODY FOR RECYCLABLE REFUSE COLLECTION VEHICLE

This invention relates to refuse collecting vehicles and more particularly to a container body for collecting recyclable materials.

BACKGROUND OF THE INVENTION

Problems encountered in providing prior art device include the inefficiency of rear loading which required two operators while front loading can be carried out by a single operator. This concept is shown in U.S. Pat. No. 2,750,055 and includes provision for loading on both sides of the vehicle.

It was desirable to separate fibers (paper, cardboard, textiles and the like) from other recyclables, and lifting of the materials was also combined with side loading as shown in Canadian 2,003,358. However, opening and closing of a top door in the container body was slow and could not be done during travel in view of the hazard created by overhead electrical wires. Reduction in height of the container was not economical since this would reduce the payload of the vehicle.

Lifting the material to obtain maximum filling of the container body as shown in Canadian Patent 1,264,702 is desirable and a conveyor for this purpose is shown in Canadian Patent 2,129,629. However, it is also desirable to compact the materials, and it has been found that hydraulic rams used to move materials up a sloping floor caused breakage of glass bottles with the result that powdered glass adversely effected the operation of the hydraulic rams. Although compacting is essential for economy reasons, the rams travel on long rails thus increasing the weight of the vehicle. Rams of this type, as shown in Canadian application 2,027,168 take up space required for recyclables.

Separating the recyclables into at least two compartments is also a requirement. In this regard, horizontal dividers have been used as shown in Canadian Patent 2,027,168. However, loading and compacting operations are complicated because the materials are not loaded from the top. Similarly, transverse dividers as shown in Canadian Patent 1,299,530 have to be moved to permit unloading. Unless side dumping of the container is provided, such a feature requires complete redesign of the vehicle and the method of operation.

This invention seeks to provide an apparatus for collecting recyclables positioned immediately behind the cab of the vehicle in front of a container body.

The invention also seeks to provide buckets on both sides of the vehicle at a convenient height for loading from either side by a single driver operator.

Furthermore, the invention seeks to provide means for raising selected recyclables to the top of the container body and compacting the containers and paper recyclables during the loading cycle.

The invention further seeks to provide an adjustable longitudinally extending vertical partition in the container body for separating paper from other recyclables.

STATEMENT OF THE INVENTION

Accordingly, the present invention reside in the provision of a refuse collecting body for use on a vehicle, the body including first and second end walls, a top wall, and a bottom wall, the first end wall having a load receiving aperture, and the second end wall being a discharge end of the container. An upwardly moveable loading bucket having a pair of upright side walls and a bottom wall defining first and second open ends, a first end of the bucket being blocked by the first end wall of the container in a loading position and a fixed wall for blocking the second end of the bucket during loading and upward movement, means to raise the bucket to and upper unloading position. A compressor blade mounted above the fixed wall slidably mounted to be moved into the bucket by reciprocal actuating means when the bucket is raised to a compacting and, or unloading position in line with the load receiving aperture of the first end wall of the container body.

BRIEF DESCRIPTION OF THE DRAWINGS

In the drawings which illustrate a preferred embodiment of the invention.

DETAILED DESCRIPTION

Figure 1:
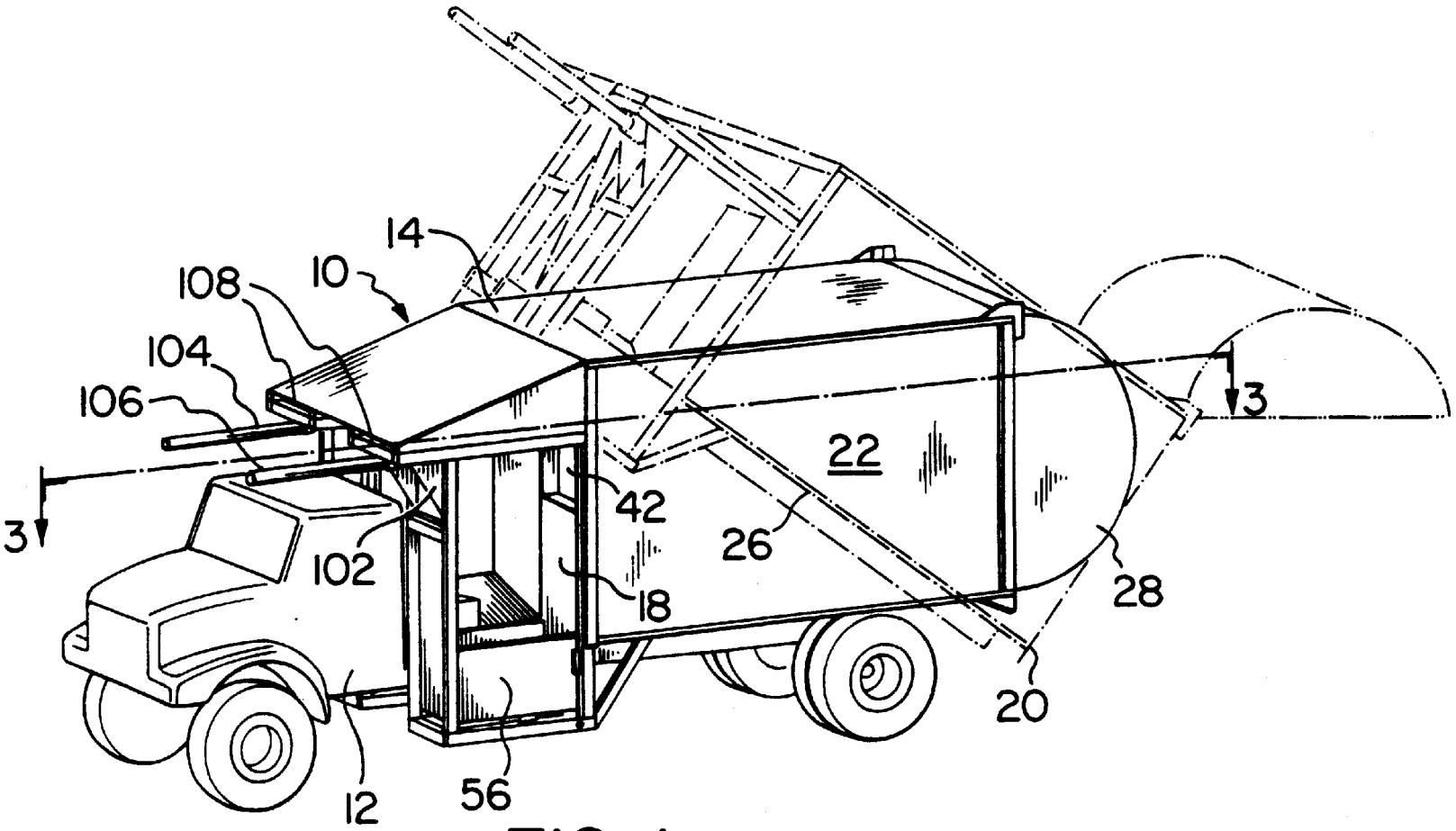
FIG. 1 is a perspective view of the container body of this invention mounted on a vehicle.

Referring now in detail to FIG. 1 of the drawings, a rear discharge recyclable material collection vehicle indicated generally at 10, includes a vehicle chassis 12 which includes a cab and a container body 14 mounted thereon.

The container body 14 has a first end wall 18, a second arcuate end wall 20 forming a discharge end, two lateral side walls 22, a top wall, and a bottom wall 26.

Figure 3:
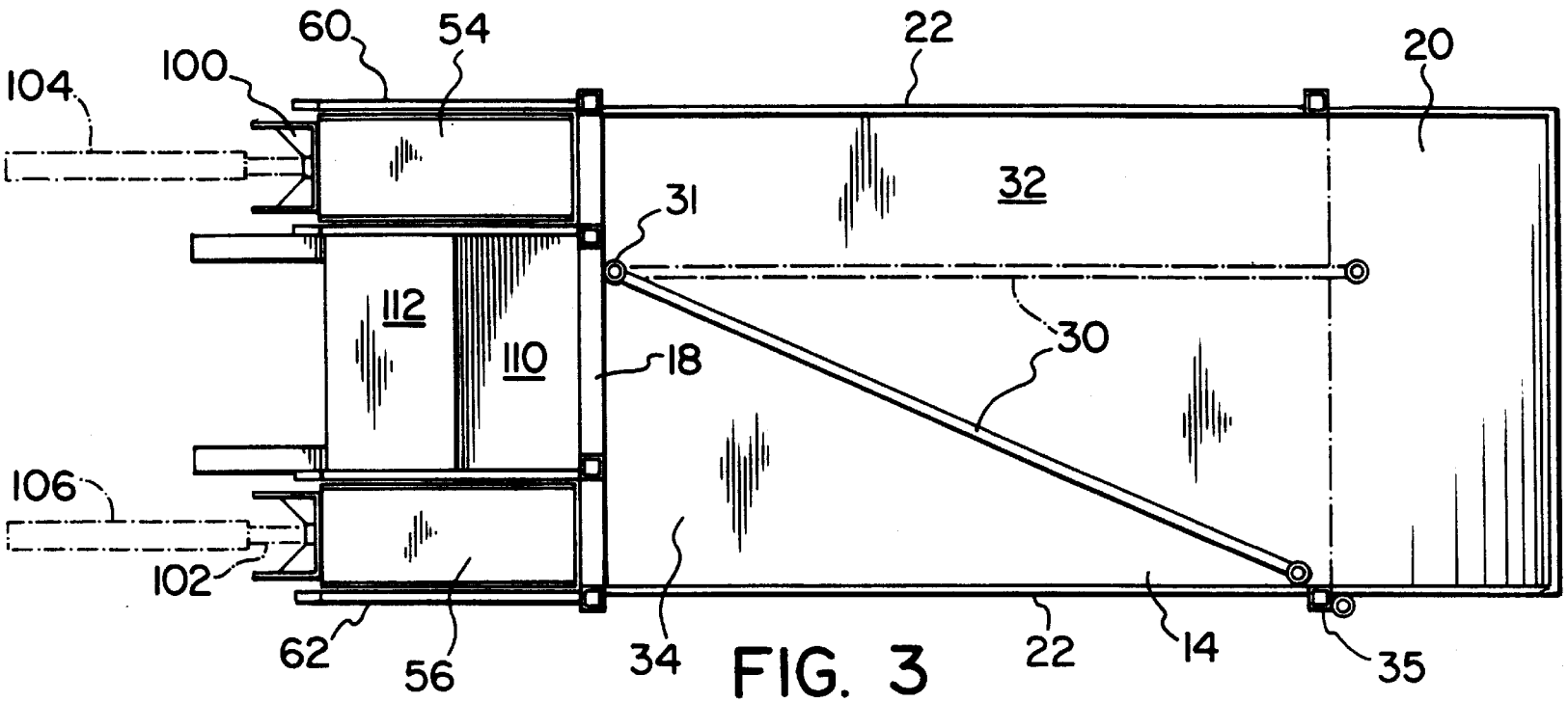
FIG. 3 is a top plan view of the container body taken along the line 3—3 of FIG. 1.

As shown in FIG. 3, a vertical partition 30 secured at one end by vertical hinges 31, extends diagonally from the first end wall 18 toward the discharge end 20, and divides the container into two substantially triangular compartments 32 and 34. A hydraulic locking mechanism 35 including retractable pin is provided at the discharge end of the partition 30.

The discharge end 20 has a semi-cylindrical tailgate 28 pivotally mounted on an adjacent edge of the top wall 24 to permit material packed in both compartments 32 and 34 to be separately discharged by selective positioning of the partition 30 as shown in broken lines. A more detailed description of the unloading operation will be provided below.

Figure 2:
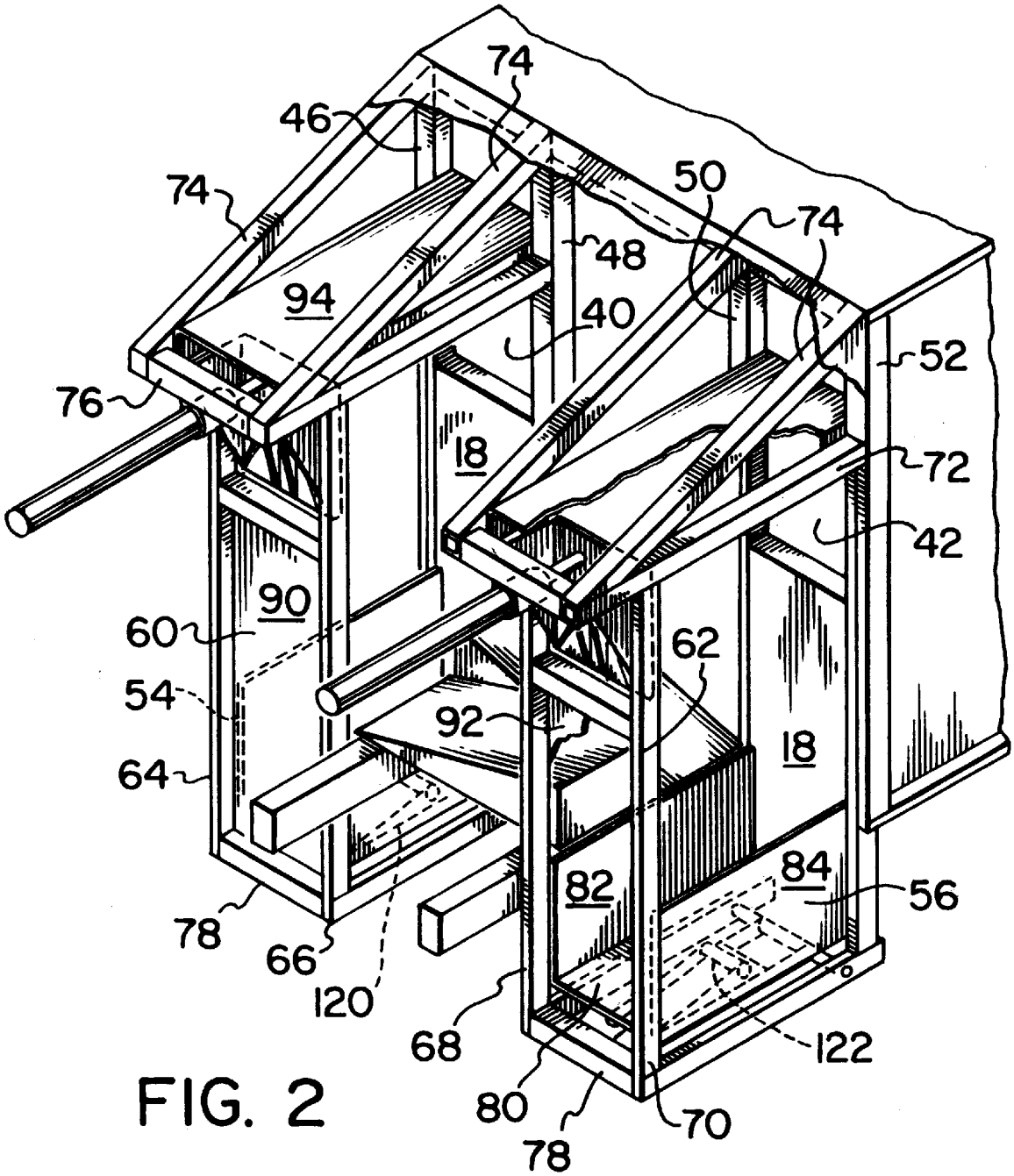
FIG. 2 is a perspective view of a front portion of the container showing the loading apparatus in greater detail.

Referring to FIG. 2, the first end wall 18 has a pair of load receiving apertures 40 and 42 adjacent the top wall 24.

Vertically disposed tubular frame members 46, 48 are provided adjacent the aperture 40, and similar frame members 50 and 52 as provided at side edges of the aperture 42.

The frame members 46, 48, 50 and 52 extend below the bottom wall 26, and form part of frame assemblies 60 and 62 to support loading buckets 54 and 56 respectively below the chassis 12 of the vehicle 10 so as to be at a convenient height for loading by an operator.

The frames 60 and 62 have vertical tubular members 64, 66,68, and 70 connected to frame members 46, 48, 50 and 52 by horizontal members 72 and diagonal reinforcing members 74. Suitable horizontal members 76 connect upper ends of the vertical members 64, 66, 68 and 70. The lower ends of vertical members 64, 66, 68 and 70 are connected by horizontal members 78.

It will be appreciated that the frame assemblies 60 and 62 guide the loading buckets 54 and 56 during upward travel to the loading apertures 40 and 42.

The loading buckets 54 and 56 are substantially identical and each has a bottom wall 80 and a pair of upright side walls 82 and 84 defining first and second open ends 86 and 88 respectively of the bucket 54 or 56.

Fixed walls 90 and 92 on each of the frame assemblies 60 and 62 blocks the open end of each bucket 54 and 56 during loading and upward travel.

Each of the frame assemblies 60 and 62 are preferably provided with a top wall 94 above each loading apertures 40 and 42.

Compressor blades 100 and 102 are mounted on hydraulic actuators such as piston cylinder assemblies 104 and 106.

The cylinders 104 and 106 are secured to upper horizontal frame members 76 as by brackets 108 in a conventional manner.

The dimensions of the compressor blades 100 and 102 are the same as the interior of the loading buckets 54 and 56 which are blocked by the blades 100 and 102 when the buckets 54 and 56 are in the upper position above fixed walls 90 and 92. Furthermore, the apertures 40 and 42 are preferably the same dimensions as the interior of the buckets 54 and 56.

In order to facilitate separation of the recyclable materials, each of the buckets 54 and 56 will be used exclusively for one general type of material. For example, assuming collection takes place on the right hand side of the street, paper, fibers and the like will be loaded into the bucket 54 and the compartment 32 of the container. Other materials will be moved down a chute 110 into the loading bucket 56 and the compartment 34.

If collection is from the left hand side of the vehicle, the operator can use a chute 112 to load the bucket 54 with paper, and other materials can be dropped directly into the loading bucket 56.

Figure 4:
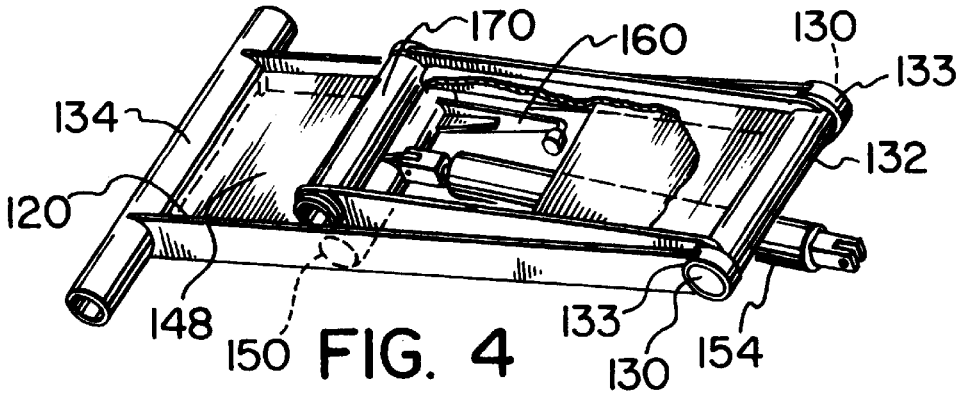
FIG. 4 is a perspective view of lifting means for a recyclable materials bucket in the lowered position.
Figure 5:
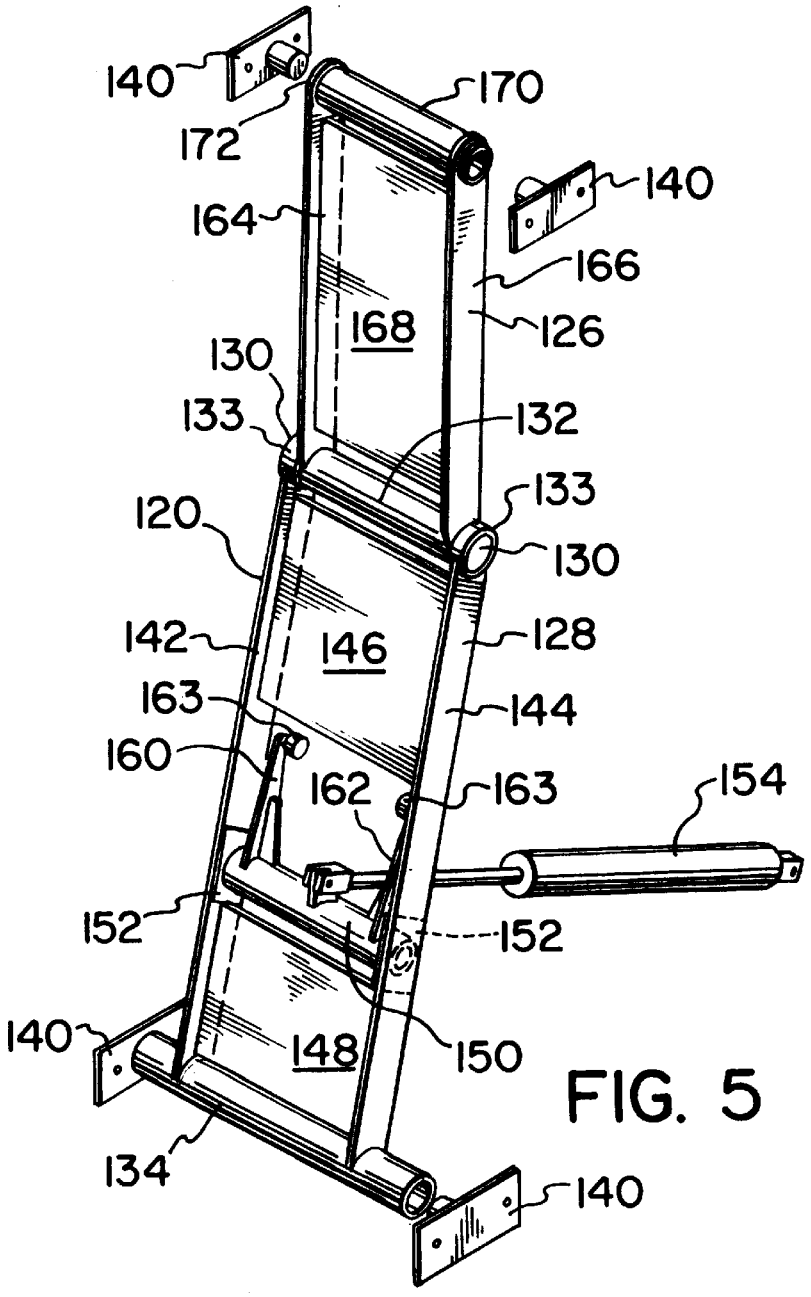
FIG. 5 is a perspective view of the lifting means of FIG. 3 in the raised position.

As shown more clearly in FIGS. 2, 4 and 5, lift means 120 and 122 are mounted on the frame assemblies 60 and 62 for raising the buckets 54 and 56. Since the lift means 120 and 122 are identical, only one need be described in detail. Accordingly, with reference to FIG. 4, the lift means 120 has upper and lower sections 126 and 128 hingedly joined by a pair of stub-shafts 130 extending into ends of a hollow transverse shaft 132 provided with suitable bearings. The lower section 128 has a tubular transverse shaft 134 at the end remote from the shaft 132. A pair of stub shafts 140 received in ends of the shaft 134 are used to rotatably mount the lower section 128 of the lift 120 on the frame assembly 60.

The lower section 128 has a pair of side members 142 and 144, having ends joined to tubular sections 133, and is reinforced by upper and lower panels 146 and 148 secured therebetween as by welding. The shafts 130 extend through the tubular sections 133.

An intermediate shaft 150 is also provided between the transverse shafts 132 and 134. The shaft 150 is rotatably mounted between the side members 142 and 144 by a pair of stub shafts 152 in the manner described above with reference to the shaft 134.

The shaft 150 has a pair of spaced elongated arms 160 and 162 secured thereto and provided with rollers 163 at their outer ends for rotation with the shaft 150 to engage the upper section 126 of the lift means 120, as shown more clearly in FIG. 4.

The upper section 126 has side members 164 and 166, a reinforcing panel 168, and a transverse tubular shaft 170 at its outer end 172. The transverse shaft 170 is rotatably secured to brackets 174 on the underside of the bucket 54, shown in FIG. 10.

Figure 13:
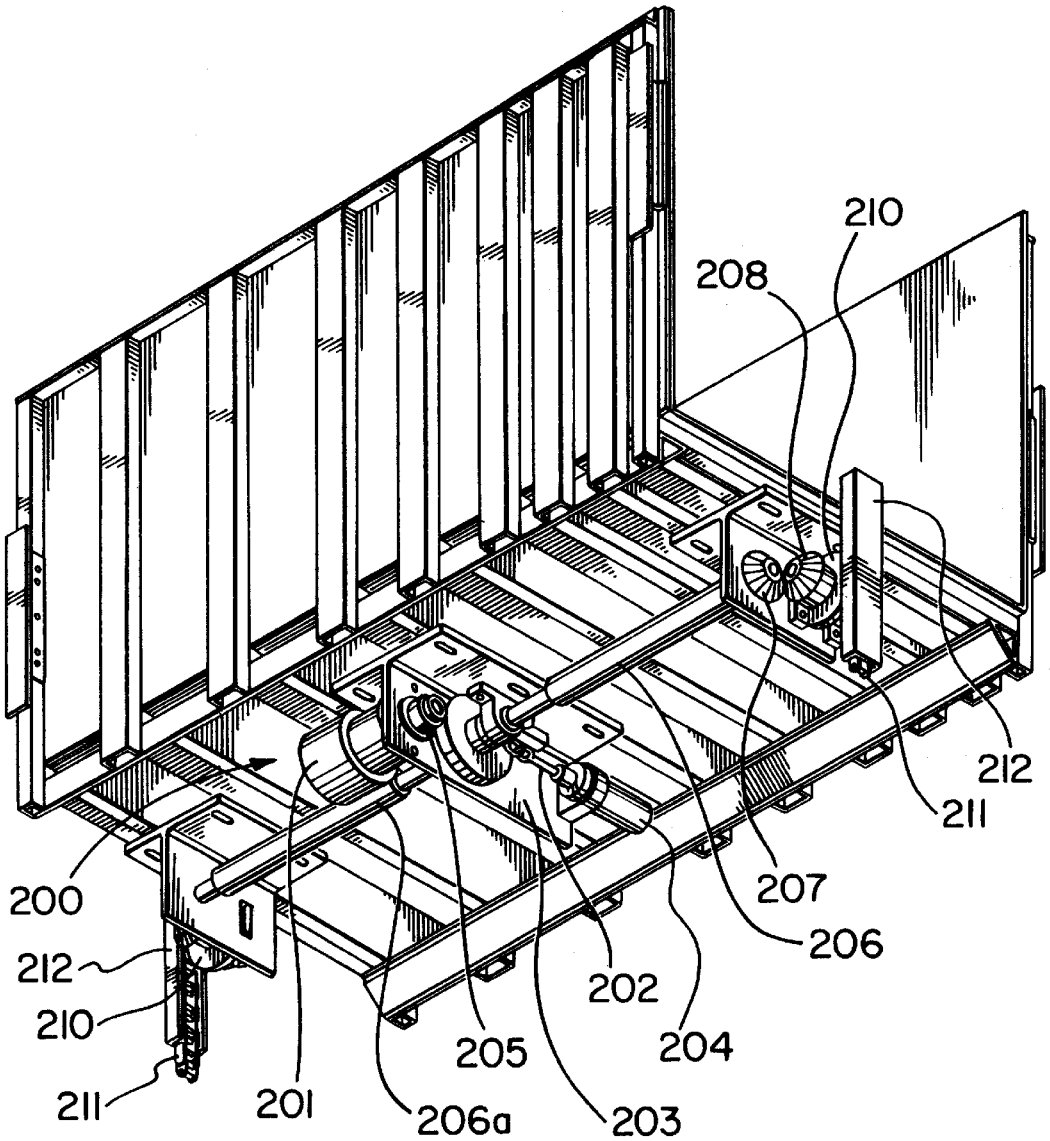
FIG. 13 is a perspective view of the underside of the bucket showing the lift means in more detail.

An alternative lifting means for lifting the buckets 54 or 56 is shown generally at 200 in FIG. 13.

The lifting means 200 includes drive means in preferably an hydraulic motor 201 on a mounting bracket 203 secured to bottom wall and connected to transmission means 205 to drive two output shafts 206 and **206*a*. The transmission 205 includes gears to provide a required gear reduction. Outer ends of the shafts 206 and 206*a* are connected to sprockets 210 through crown gears 208 and 209. Each of the sprockets 210 engage chains 211 secured in channels 212, attached to the frame assemblies 60 or 62**.

A ratchet wheel 203 carried by the transmission shaft is engaged by a spring loaded pin 202 to maintain the bucket 54 in a raised position. The pin 202 is retracted by a hydraulic piston 204.

Suitable brackets 207 are used to rotatably mount the ends of the shafts and the associated sprockets 210 on the underside of the bucket 54 at the end edges of the bottom wall.

Figure 14:
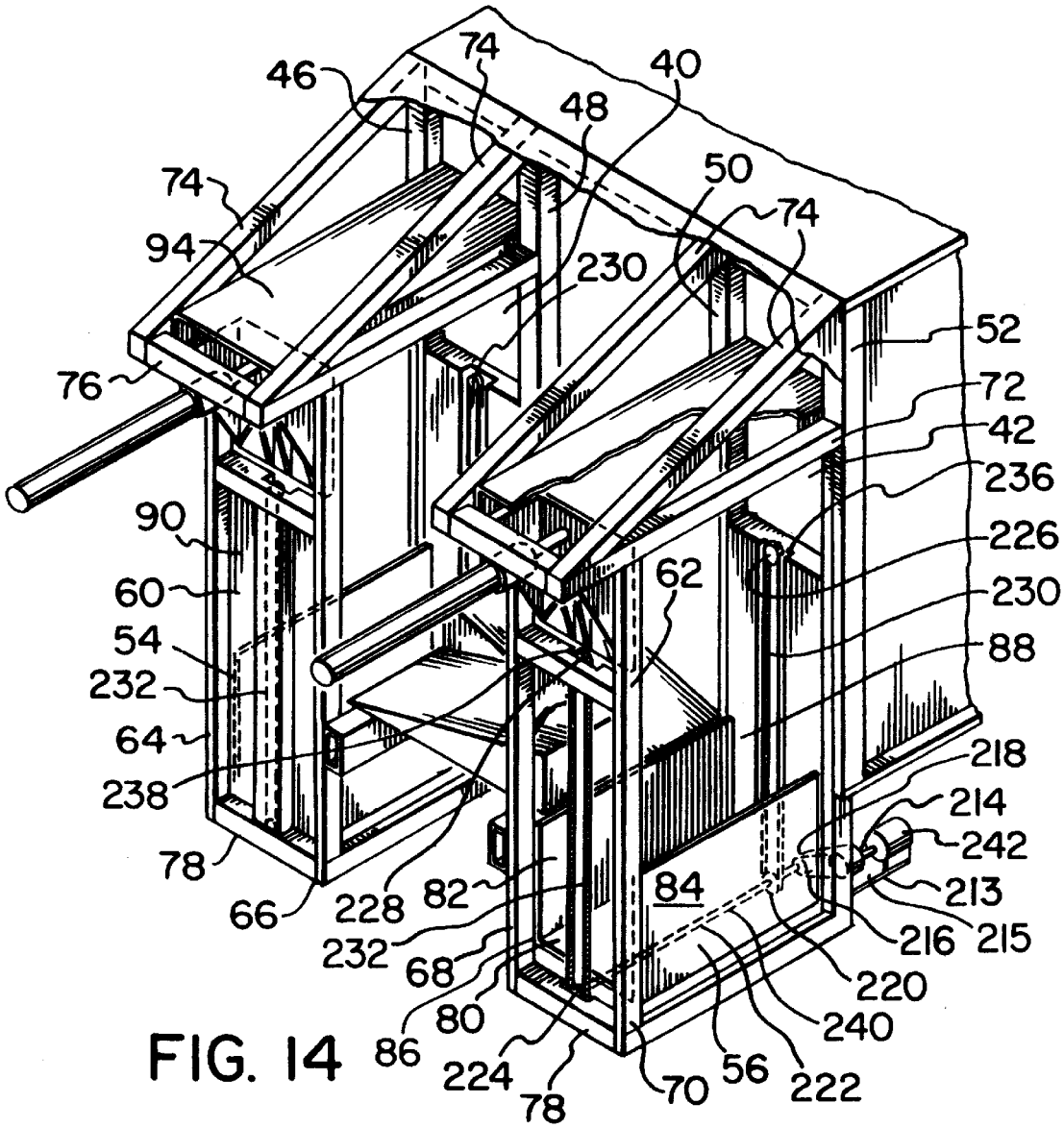
FIG. 14 is a perspective view of the apparatus including alternative left means.

The alternative left means 240 shown in FIG. 14 includes drive means preferably on hydraulic motor 242 mounted on a bracket 213 secured to the frame assembly 62. A belt drive assembly 215 includes a pulley 214 on the shaft (not shown) of the motor 242, a belt 216, a driven pulley 218, and a drive sprocket 220 secured to a first end of a shaft 222. A second drive sprocket 224 is secured to a second end of the shaft 222.

First and second idler sprockets 226 and 228 are rotatably mounted at the upper portions of the frame assembly 68 and a chain 230 entrains the sprockets 220 and 226, and a second chain 232 entrains the sprockets 224 and 228. The chains 230 and 232 are preferably received in recesses 236 and 238 provided in the frame assembly 68. Vertical movement of the bucket 54 is provided by securing a link of each of the chains 230 and 232 to a suitable bracket provided on an adjacent portion of the bucket 54.

A substantially identical left means 240 including chains 230 and 232 is mounted on the bucket 54 and need not be described in detail.

Figure 10:
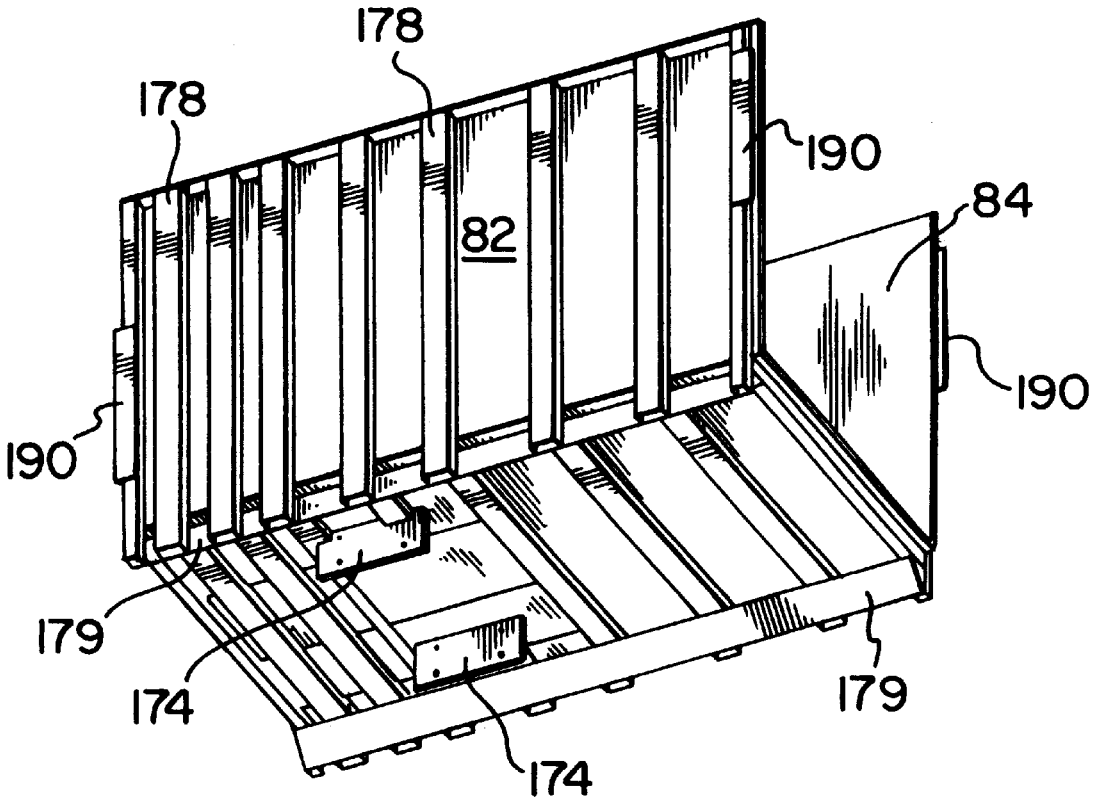
FIG. 10 is a perspective view of the bucket.

It will be appreciated that the buckets 54 and 56 do not have end walls and therefore must be reinforced to withstand the unloading and compacting stresses. As shown in FIG. 10, vertical ribs 178 are provided on the walls 82 and 84 of bucket 54 and both the bucket 54 and 56 are substantially identical. The ribs 178 are closer together adjacent the container 14 where compacting forces will be greater, lower ends of the ribs 178 extend below the bottom wall 80, the lower ribs on each side wall 82 and 84 are provided with a tubular reinforcing member 179 of triangular cross-section. Vertical ends of the wall 82 and 84 are provided with friction reducing means 190 such as guides of suitable plastic material preferably very high molecular weight polyethylene, or rollers.

Figure 11:
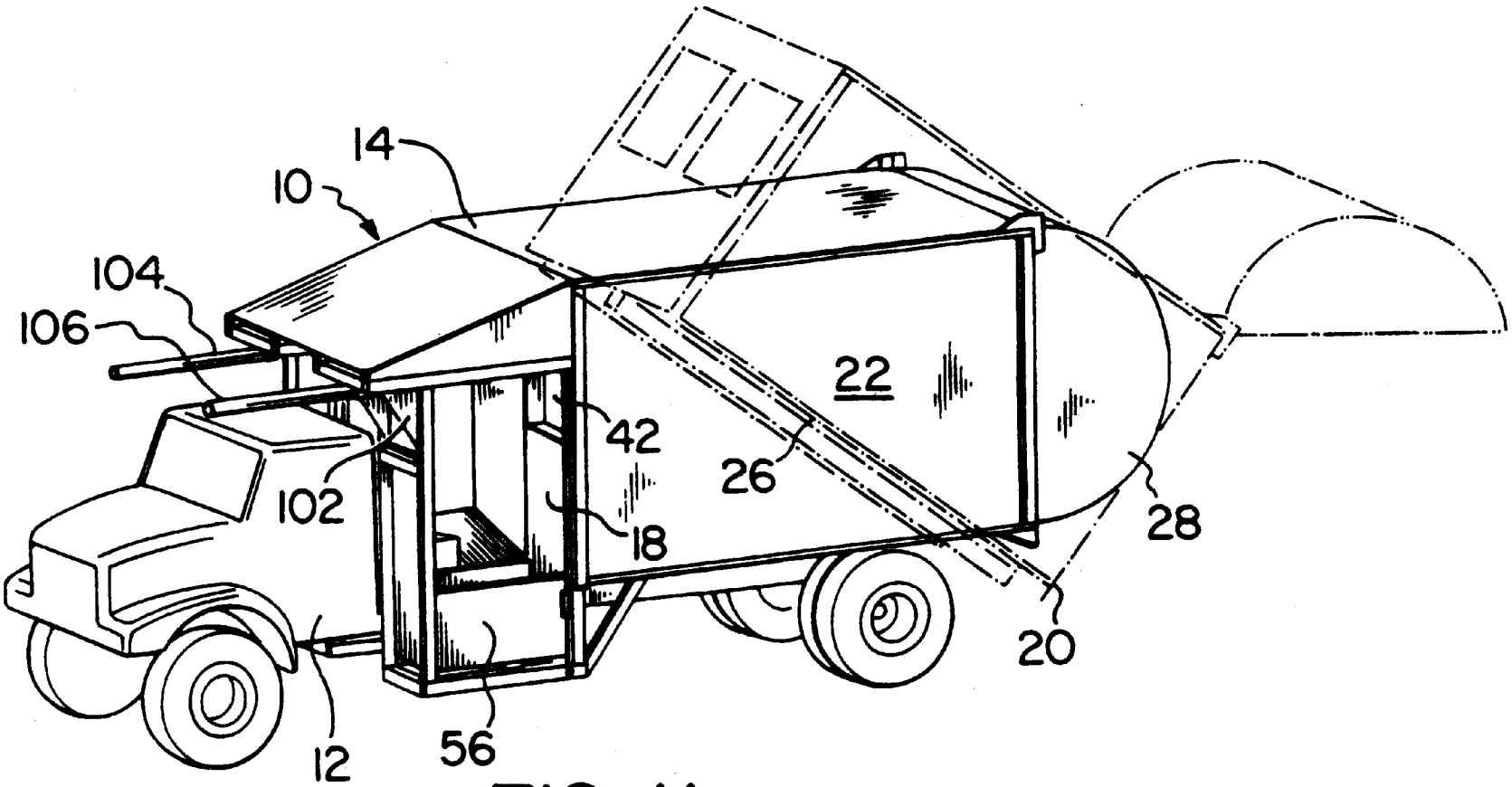
FIG. 11 is a perspective view of an alternative construction of the container body.
Figure 12:
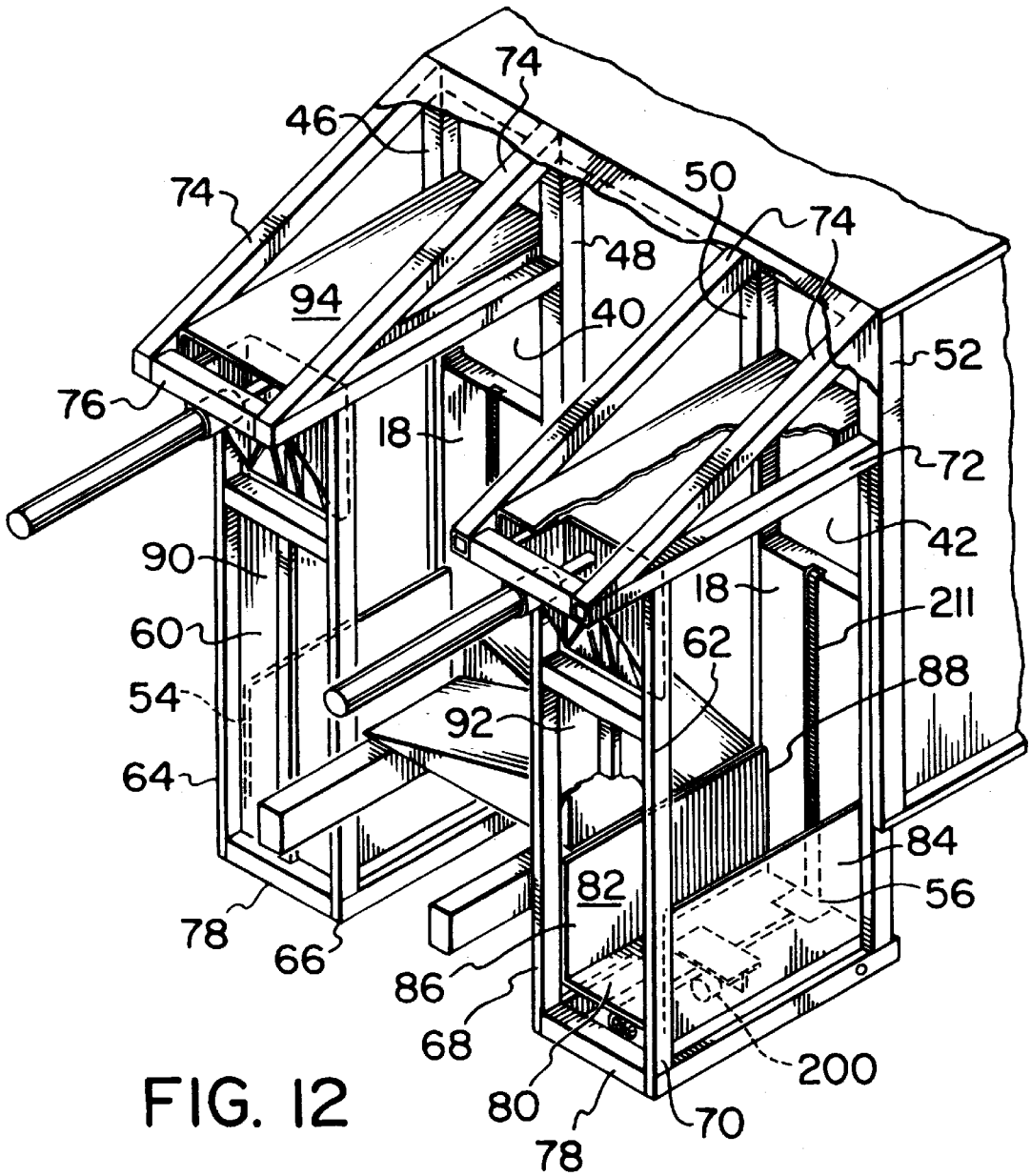
FIG. 12 is a perspective vie of a front portion of the loading apparatus including alternative lift means.

The container 14 has hydraulic lift means not shown to raise the container in a conventional manner as shown in broken lines in FIG. 1. As shown in FIG. 11, the container 14 may be lifted while the frame assemblies 60 and 62 remain fixed.

Figure 6:
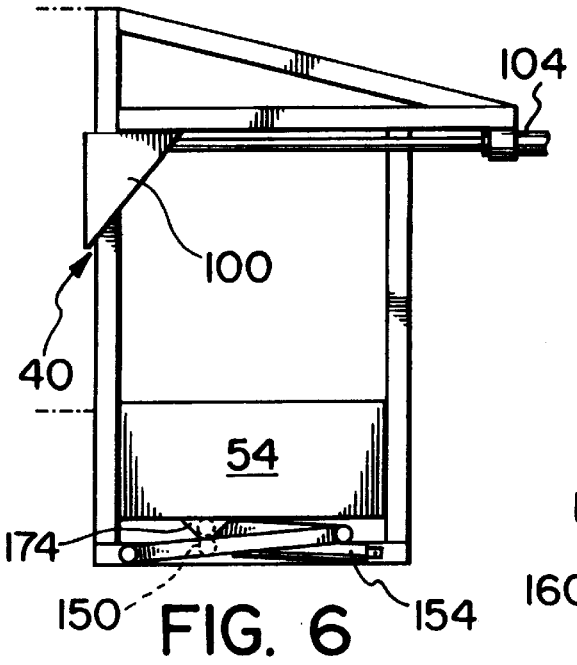
FIG. 6 is a diagrammatical representation of the bucket and lift means in the lowered position, and the hydraulic ram in the closed position for travelling.
Figure 7:
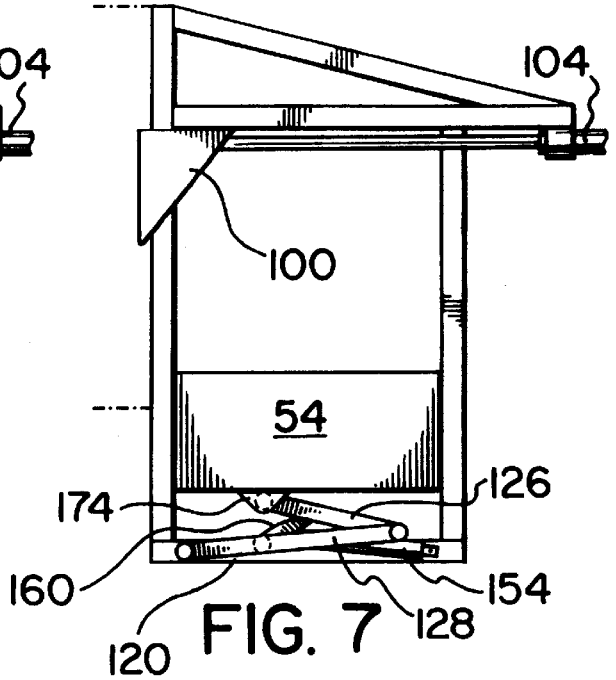
FIG. 7 is a diagrammatical representation of the lift means of FIGS. 4 and 5 in an intermediate partly raised state.
Figure 8:
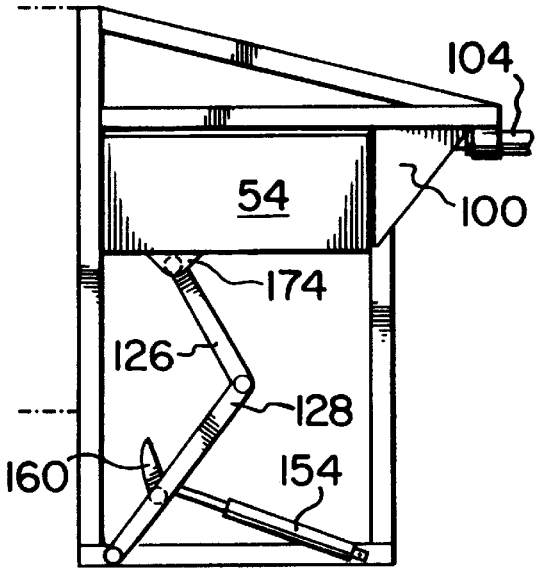
FIG. 8 is a diagrammatical representation of the lifting means and the bucket in the raised position, and the hydraulic ram during a compacting cycle.

Operation of the collection vehicle 10 will be explained with particular reference to FIGS. 6, 7, 8 and 9. As shown in FIG. 6, the bucket 54 is in the lowered position where it is filled with the selected recyclable materials either paper and fibers or the other materials such as metal, plastic and glass. The compressor blade 100 is blocking the aperture 40 at this stage of the operating cycle. FIG. 7 illustrates the first stage of moving the bucket upwardly. The shaft 150 and cams 160 are rotated by the piston 154 thereby providing limited upward movement of the upper section 126 of the lifting means 120. The blade 100 is withdrawn to the position shown in FIG. 8. Continued upward movement of the bucket 54 as shown in FIG. 8 results from the piston 154 moving the lower section 128 of the lifting mechanism 120 upward.

Figure 9:
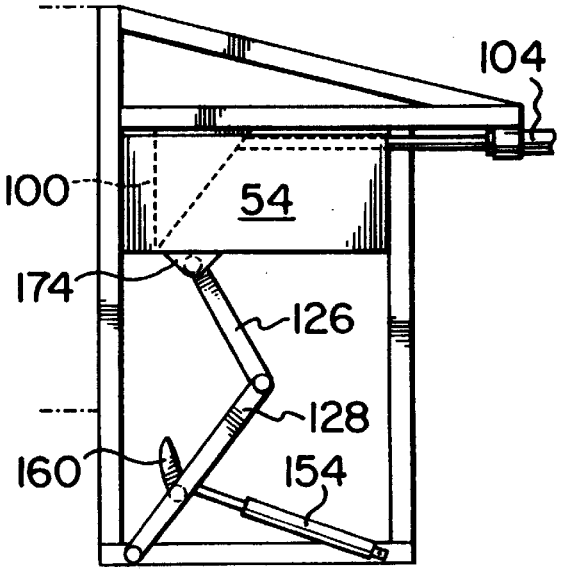
FIG. 9 is a diagrammatical representation of the lifting means in the raised position.

Compressing the recyclable materials and moving the compressed materials into the container 14 through the aperture 40 is accomplished by operating the hydraulic cylinder and moving the compressor blade to the left as shown in FIG. 9. The raising and compacting steps outlined above can be carried out automatically while the operator is moving the vehicle 12 to another site.

Unloading of the container body 14 is facilitated by the moveable diagonal vertical partition 30 in that a wide mouth is provided for the discharge of the contents of compartment 32 when the container 14 is raised in the conventional manner and the tail gate 28 at the discharge end 20 is unlatched by a conventional hydraulic means. The latching means of the partition 30 is then operated so that the partition 30 can be moved to a position approximately parallel with walls 22 thereby facilitating the discharge of the contents of the compartment 34.

It will be understood that other lifting mechanisms can be used to raise the buckets 54 and 56 into the compacting and container loading position. For example, a conventional hydraulic motor can be used to move a cable system connected to upper and lower corners of the bucket 54 or 56. The cable is connected at both ends of the bucket so as to form two loops entraining suitable pulleys. The lower pulleys are driven by the reversible hydraulic motor to raise and lower the bucket by moving the cable loops and the attached bucket.

The embodiments of the invention in which an exclusive property or privilege is claimed are defined as follows:

1. A refuse collecting container for use on a refuse collection vehicle, said container comprising:

first and second end walls, side walls, a top wall and a bottom wall, said first end wall having a load receiving aperture, and the second end wall being a discharge end of the container;

a vertically moveable loading bucket having a pair of upright side walls, and a bottom wall defining a first open end and a second open end of the bucket;

the first end of the bucket ordinarily being blocked by the first end wall of the container;

a fixed wall blocking the second end of the bucket during loading and upward movement;

means for raising the bucket adjacent the load receiving aperture in the first end wall of the container; and a compressor blade mounted above the fixed wall and having actuator means for moving the blade through the bucket when the bucket is aligned with the load receiving aperture in the first end wall of the container.

2. A refuse collecting container as claimed in claim 1 wherein the means for raising said bucket comprises:

first and second lift members hingedly joined at adjacent ends;

an outer end of the first member being pivotally joined to the bucket;

an outer end of the second member being pivotally joined to a frame member of said container and a hydraulic piston cylinder assembly mounted between the frame member and the first lift member for moving the lift members from a folded lower position to an open raised position thereby raising the bucket to an upper position adjacent the loading aperture.

3. A refuse collecting container as claimed in claim 1 wherein the means for raising said bucket comprises:

rack means at the first and second ends of the bucket secured on the first end wall and the fixed wall of the container, circular toothed means engaged in said rack means rotatably mounted on an underside of said bucket and drive means for rotating the toothed means in unison to move said bucket.

4. A refuse collecting container as claimed in claim 1 wherein the means for raising said bucket comprises:

a drive sprocket and an idler sprocket at the first end of the bucket rotatably mounted on a frame assembly;

a drive sprocket and an idler sprocket rotatably mounted on a frame assembly at the second end of the bucket;

a shaft interconnecting the drive sprockets;

first and second chains entraining the drive sprockets and the idler sprocket, and secured to the bucket to provide vertical movement of the bucket and drive means for rotating the shaft and the drive sprockets to move the chains.

5. A refuse collecting container for use on a refuse collection vehicle, said container comprising:

first and second end walls, side walls, a top wall and a bottom wall, said first end wall having load receiving apertures, and the second end wall being a discharge end of the container;

at least two loading buckets vertically moveable in a frame assembly, each having a pair of upright side walls, and a bottom wall defining a first open end and a second open end of the bucket;

the first end of each bucket ordinarily being blocked by the first end wall of the container;

a fixed wall blocking the second end of each bucket during loading and upward movement;

means for raising each of the buckets adjacent each load receiving aperture in the first end wall of the container; and a compressor blade mounted above each of the bucket on the fixed wall and having actuator means for moving the blades through the buckets when the buckets are aligned with the load receiving in the first end wall of the container.

6. A refuse container as claimed in claim 5 including a vertical longitudinal partition extending from the first end wall to the discharge end of the container and dividing the container into two compartments.

7. A refuse container as claimed in claim 6 including locking means for locking the partition in a position not parallel with the sidewall during loading while permitting the partition to be moveable to a position parallel to the side walls of the container during unloading.

* * * * *